US012352188B2

(12) United States Patent
De Giovanni et al.

(10) Patent No.: US 12,352,188 B2
(45) Date of Patent: Jul. 8, 2025

(54) HOLLOW POPPET VALVE AND METHOD OF MANUFACTURING

(71) Applicant: Eaton Intelligent Power Limited, Dublin (IE)

(72) Inventors: Pierfrancesco De Giovanni, Lecce (IT); Luigi Lia, Turin (IT); Marco Aimo Boot, Nole (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/637,109

(22) Filed: Apr. 16, 2024

(65) Prior Publication Data

US 2024/0254900 A1 Aug. 1, 2024

Related U.S. Application Data

(63) Continuation of application No. PCT/EP2022/025516, filed on Nov. 16, 2022.

(60) Provisional application No. 63/279,787, filed on Nov. 16, 2021.

(51) Int. Cl.
*F01L 3/20* (2006.01)
*F01L 3/02* (2006.01)

(52) U.S. Cl.
CPC ..... *F01L 3/20* (2013.01); *F01L 3/02* (2013.01); *F01L 2303/00* (2020.05)

(58) Field of Classification Search
CPC ..... F01L 3/20; F01L 3/02; F01L 2303/00
See application file for complete search history.

(56) References Cited

U.S. PATENT DOCUMENTS 2,218,983 A 10/1940 Daisley
6,006,713 A * 12/1999 Gebauer ..... F01L 3/14 123/188.8
2021/0190212 A1* 6/2021 Aimasso ..... F01L 3/14

FOREIGN PATENT DOCUMENTS

WO WO 2019081397 A1 5/2019

OTHER PUBLICATIONS

International search report and Written Opinion received for PCT Application No. PCT/EP2022/025516, 10 pages, Mar. 2, 2023.

* cited by examiner

*Primary Examiner* — Kevin A Lathers
(74) *Attorney, Agent, or Firm* — Baker Botts L.L.P.

(57) ABSTRACT

A poppet valve, in particular a hollow poppet valve, includes: a valve stem; a valve body having along a longitudinal axis, a first end with a neck portion to which the valve stem is coaxially arranged and having along a longitudinal axis a second end with a first outer contact face portion, the valve body including a cavity with a first opening towards the first end and a second opening towards the second end; and a valve cap coaxially arranged to the valve body on the second end for closing the second opening, the valve cap having a second outer contact face portion to form together with the first outer contact face portion a valve head contact face.

20 Claims, 3 Drawing Sheets

HOLLOW POPPET VALVE AND METHOD OF MANUFACTURING

PRIORITY

This application is a continuation under 35 U.S.C. § 365(c) of International Patent Application No. PCT/EP2022/025516, filed Nov. 16, 2022, which claims the benefit of priority of U.S. Provisional Patent Application No. 63/279,787, filed Nov. 16, 2021, which are incorporated herein by reference in its entirety.

TECHNICAL FIELD

The invention relates to a poppet valve, in particular a hollow poppet valve. Poppet valves are for example used in combustion engines to open and close the inlet and outlet ports to the cylinders. As the power of combustion engines increases, the heat production also increases. To this end it is known to provide hollow poppet valves, which are filled with for example sodium for better heat exchange.

BACKGROUND

In order to maximize the heat exchange of hollow poppet valves and with the aim of reducing knocking tendency of gasoline engines, the cavity in the valve head should be as large as possible. A number of manufacturing methods are known to produce such poppet valves.

For example US 2016356186 proposes a valve, in which a valve body is provided with a cavity opening at an axial end. This cavity is closed by a valve cap, which is welded to the valve body. The weld is arranged in the axial end surface of the valve, such that the weld is directly subjected to the heat of the combustion process. This could result in fatigue of the weld and as a result leakage of the sodium in the hollow poppet valve into the cylinders of the combustion engine.

Other manufacturing methods are known, in which the valve head is formed as one piece. For example JP 1995208127 disclosed a method in which a hollow valve head is shaped out of a solid material. The resulting cavity, especially in the head itself, is very limited.

Also US 20120255175 discloses a method in which a rod with a blind hole is shaped into a poppet valve. Also with this method, the size of the cavity of the valve head is limited.

SUMMARY OF PARTICULAR EMBODIMENTS

In an embodiment, a poppet valve is disclosed, in particular a hollow poppet valve, comprising: a valve stem; a valve body having along a longitudinal axis, a first end with a neck portion to which the valve stem may be coaxially arranged and having along a longitudinal axis a second end with a first outer contact face portion, the valve body comprising a cavity with a first opening towards the first end and a second opening towards the second end; and a valve cap coaxially arranged to the valve body on the second end configured to close the second opening, the valve cap having a second outer contact face portion to form together with the first outer contact face portion a valve head contact face.

In a particular embodiment, which may combine the features of some or all above embodiments, both the first and second outer contact face portions may comprise a circumferential groove portion to form together a circumferential face groove, which may provide for a space to arrange a seat facing material, and which may be formed having a shape intended to improve welding process aspects, valve performance, reliability, and/or robustness.

In a particular embodiment, which may combine the features of some or all above embodiments, the valve cap may comprise a cylindrical upright wall, which may extend into the second opening of the cavity and centers the valve cap relative to the valve body.

In a particular embodiment, which may combine the features of some or all above embodiments, a second inner contact face portion of the valve cap may abut the first inner contact face portion of the valve body, and a first and a second weld surface of the valve body and the valve cap, respectively, may contact each other at a welding interface.

In a particular embodiment, which may combine the features of some or all above embodiments, the length of a welding line, which may be defined by joining an inner edge and an outer edge of the welding interface, respectively, in a longitudinal cross-section of the poppet valve, may lie between 0.5 millimeters and 3.5 millimeters, the length of the welding line being inclusive of both end values In a particular embodiment, which may combine the features of some or all above embodiments, an angle $\alpha$ made by the welding line with an axis that is perpendicular to the longitudinal axis of the valve body in the longitudinal cross-section may lie between −80° and +90°, a being inclusive of both end values.

In a particular embodiment, which may combine the features of some or all above embodiments, the weld surfaces may be formed to enable a weld interface shape intended to improve welding process aspects, valve performance, reliability, and/or robustness.

In a particular embodiment, which may combine the features of some or all above embodiments, inner contact face portions may be formed having a contact shape intended to protect the welding, distribute forces between the valve cap and valve body, and improve other welding process aspects, valve performance, reliability, and/or robustness.

In a particular embodiment, which may combine the features of some or all above embodiments, a space may be formed between the first coupling weld surface of the valve body and the second inner contact face portion of the valve cap, the space being provided for any welding residual materials.

In a particular embodiment, which may combine the features of some or all above embodiments, a space may be formed between the first coupling weld surface of the valve body and the second inner contact face portion of the valve cap, the space being provided for any welding residual materials, the space being obtained in the valve cap portion of the poppet valve, the shape and size of the space being selected and formed to improve welding process aspects, valve performance, reliability, and/or robustness.

In a particular embodiment, which may combine the features of some or all above embodiments, a space may be formed between the first coupling weld surface of the valve body and the second inner contact face portion of the valve cap, the space being provided for any welding residual materials, the space being obtained in the valve body portion of the poppet valve, the shape and size of the space being selected and formed to improve welding process aspects, valve performance, reliability, and/or robustness.

In a particular embodiment, which may combine the features of some or all above embodiments, a space may be formed between the first coupling weld surface of the valve body and the second inner contact face portion of the valve cap, the space being provided for any welding residual materials, the space being obtained in both the valve cap and valve body portions of the poppet valve, the shape and size of the space being selected and formed to improve welding process aspects, valve performance, reliability, and/or robustness.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DESCRIPTION OF EXAMPLE EMBODIMENTS

Figure 1A:
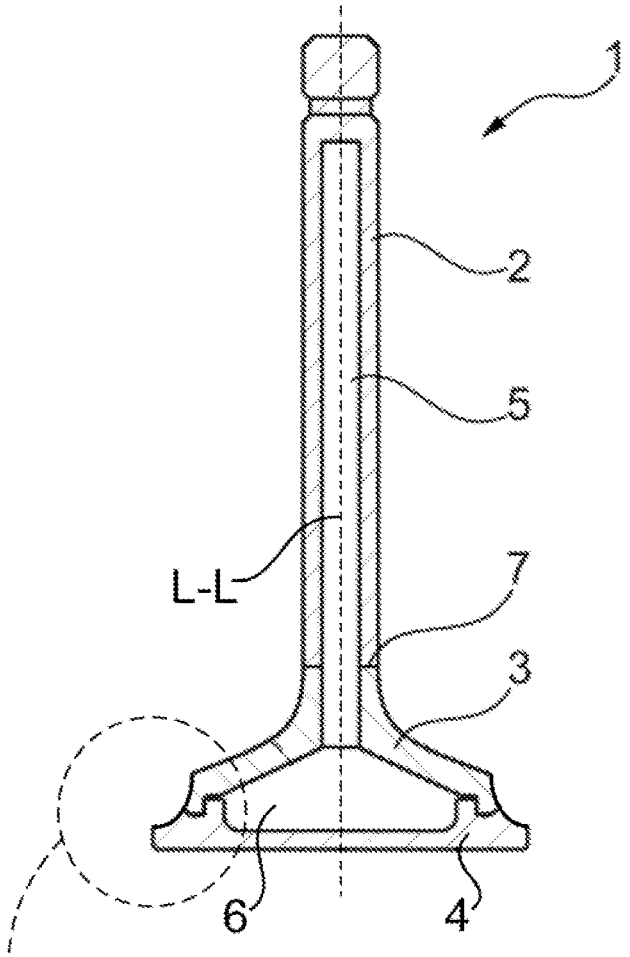
FIGS. 1A and 1B illustrate a longitudinal cross-sectional schematic view of an embodiment of a poppet valve, and of an enlarged part of an embodiment of the valve head, respectively.

In an embodiment, the present invention reduces the above mentioned disadvantages.

In an embodiment, the present invention provides a poppet valve according to the invention, which poppet valve comprising:

a valve stem;

a valve body having along a longitudinal axis a first end with a neck portion to which the valve stem may be coaxially arranged and having along a longitudinal axis a second end with a first outer contact face portion, wherein the valve body comprises a cavity with a first opening towards the first end and a second opening towards the second end;

a valve cap coaxially arranged to the valve body on the second end for closing the second opening, wherein the valve cap has a second outer contact face portion to form together with the first outer contact face portion a valve head contact face.

With the disclosed poppet valve, the valve body may be manufactured with a cavity having a second opening towards the second end. This second opening may be closed by the valve cap. Because the valve cap provides for a second outer contact face portion, which forms together with the first outer contact face portion a valve head contact face, the partition surface between the valve body and the valve cap may no longer be positioned in direct contact with the combustion process in the cylinder. This may ensure that the impact of the combustion process onto the attachment between the valve body and the valve cap is lower, such that the chance on leakage of sodium or the like from the cavity may be reduced.

In an embodiment of the poppet valve, both the first and second outer contact face portions may comprise a circumferential groove portion to form together a circumferential face groove and wherein a layer of seat facing material, for example cobalt based or iron based, may be arranged in the circumferential face groove.

The circumferential groove may provide for a space to arrange a seat facing material and covering the partition surface, such that the partition surface between the valve body and the valve cap may be shielded from any contact with the combustion process in the cylinder.

As seen in a cross-sectional view of the poppet valve, the circumferential groove portion may be formed having a shape intended to improve welding area, welding reliability, other welding process aspects, and/or improve feasible manufacturability. Additionally, as seen in a cross-sectional view of the poppet valve, the circumferential groove portion may be formed having a shape intended to improve valve performance, reliability, and/or robustness. In particular embodiments, by way of example and not limitation, the shape of the circumferential groove portion may be curved or arcuate, as seen in a cross-sectional view of the poppet valve. In particular embodiments, by way of example and not limitation, the shape of the circumferential groove portion may be conical or linear, as seen in a cross-sectional view of the poppet valve.

In a further embodiment of the poppet valve, the valve cap may be welded to the valve body, which weld may be arranged between the first and second outer contact face portions.

In yet another embodiment of the poppet valve, the valve cap may comprise a cylindrical upright wall, which may extend into the second opening of the cavity and centers the valve cap relative to the valve body.

The upright wall may allow for easy positioning of the valve cap into the cavity of the valve body, but may also provide for absorption of forces between the valve cap and the valve body, such that the weld between the valve body and valve cap may be at least partially relieved from stresses between the valve body and the valve cap. In particular embodiments, a tolerance gap may be provided between the upright wall of the valve cap and the corresponding engaging surface of the valve body. The tolerance gap may provide benefits for accommodating manufacturing and operational variations, which may lead to improved valve manufacturability, reliability, and/or performance.

In still another embodiment of the poppet valve, the valve stem may comprise a stem cavity with an opening connecting to the first opening of the cavity of the valve body.

With the stem cavity connected to the cavity of the valve body, the poppet valve may be provided with a cavity extending through the whole poppet valve. This cavity may be filled with sodium or the like to enhance the heat transfer of the valve, which may reduce the chance of leakage compared to conventional poppet valves.

In yet a further embodiment of the poppet valve, the valve body may further comprise a first inner contact face portion arranged coaxial with the longitudinal axis of the valve body and a first weld surface extending under the first outer contact face portion, wherein the first inner contact face portion may transition in a radial outward direction into the first weld surface; and wherein the valve cap may further comprise a second inner contact face portion arranged coaxial with the longitudinal axis of the valve cap and a second weld surface extending under the second outer contact face portion, wherein the second inner contact face portion may abut the first inner contact face portion, and the first and second weld surfaces may contact each other at a welding interface.

A welding line may be defined by joining the inner edge of the welding interface with the outer edge of the welding interface in a longitudinal cross-section of the poppet valve.

In particular embodiments, a length of the welding line may lie between 0.5 millimeters and 3.5 millimeters, inclusive of both end values.

The welding line may make an angle α with an axis that is perpendicular to the longitudinal axis of the valve body in the longitudinal cross-section, angle α being positive when the inner edge of the welding interface is longitudinally extended away from valve body toward the valve cap relative to the outer edge of the welding interface, angle α being negative when the outer edge of the welding interface is longitudinally extended away from valve body toward the valve cap relative to the inner edge of the welding interface, and angle α being zero when the outer edge of the welding interface and the inner edge of the welding interface lie in an identical plane that is perpendicular to the longitudinal axis of the valve body. In particular embodiments, the angle α may lie between −80° and +90°, a being inclusive of both end values.

As seen in a cross-sectional view of the poppet valve, the weld surfaces may be formed to enable a weld interface shape intended to improve welding area, welding reliability, other welding process aspects, and/or improve feasible manufacturability. Additionally, as seen in a cross-sectional view of the poppet valve, the weld surfaces may be formed to enable a weld interface shape intended to improve valve performance, reliability, and/or robustness. In particular embodiments, by way of example and not limitation, the weld interface shape may be curved or arcuate, as seen in a cross-sectional view of the poppet valve. In particular embodiments, by way of example and not limitation, the weld interface shape may be conical or linear, as seen in a cross-sectional view of the poppet valve.

The contact between both inner contact face portions may ensure that any stresses between the weld surfaces and especially in the weld are reduced or even prevented.

As seen in a cross-sectional view of the poppet valve, the inner contact face portions may be formed having a contact shape intended to protect the welding, distribute forces between the valve cap and valve body, improve valve performance, reliability, robustness, and/or feasible manufacturability. In particular embodiments, by way of example and not limitation, the contact shape of the inner contact face portions may be curved or arcuate, as seen in a cross-sectional view of the poppet valve. In particular embodiments, by way of example and not limitation, the contact shape of the inner contact face portions may be conical or linear, as seen in a cross-sectional view of the poppet valve.

The radius of the outer edge of the first inner contact face portion may be selected to be smaller than the radius of the outer edge of the second inner contact face portion, such that a space may be formed between the first coupling weld surface and the second inner contact face portion.

By providing a space between the first weld surface and the second inner face portion a space for any welding residual may be provided, which may avoid the starting of cracks in the weld. This space, which may also be called a vent chamber, may be obtained in either the valve cap portion of the poppet valve, or the valve body portion of the poppet valve, or both portions (the valve cap and the valve body) of the poppet valve. Consequently, as seen in a cross-sectional view of the poppet valve, the shape of this space or vent chamber may be formed to enable improvements in welding area, welding reliability, other welding process aspects, and/or to improve feasible manufacturability. Additionally, as seen in a cross-sectional view of the poppet valve, the shape of this space or vent chamber may be formed to enable a weld interface shape intended to improve valve performance, reliability, and/or robustness. In particular embodiments, the shape of this space, or vent chamber, may be rounded at one or more locations, as seen in a cross-section view of the valve head. One or more rounded surfaces may provide beneficial reduction of mechanical and/or thermal stresses, and/or stress concentrations, during valve manufacturing and/or valve operation, with corresponding improvements in valve manufacturability, reliability, and/or performance.

The disclosure also relates to a method for manufacturing a poppet valve, which method comprises the steps of:

- providing a poppet valve as described herein, wherein the valve body may be provided by machining and/or welding and/or forming;
- welding the valve cap and valve body together by arranging a weld between the first and second outer contact face portions; and
- covering the weld by a layer of seat facing material.

In an embodiment of the method, the weld may be covered by a layer of seat facing material using plasma transferred arc welding. By way of example and not limitation, plasma transferred arc welding may allow for a variety of materials to be arranged in the circumferential face groove, especially for relatively hard materials, which may be well suited for a valve seat surface. By way of example and not limitation, some other options to arrange the layer of seat facing material may by laser welding and projection welding.

Figure 1B:
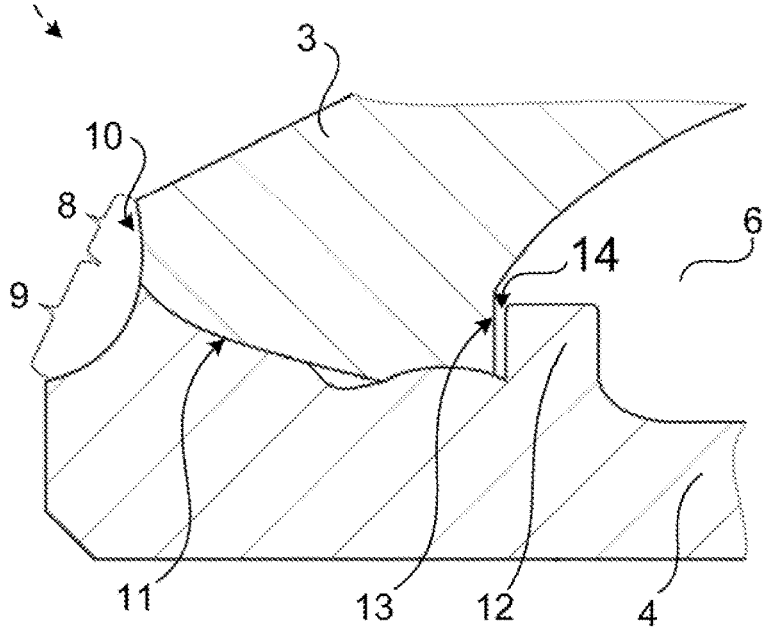

FIGS. 1A and 1B illustrate a longitudinal cross-sectional schematic view of an embodiment of a poppet valve, and of an enlarged part of an embodiment of the valve head, respectively. A poppet valve 1 is illustrated with a valve stem 2, a valve body 3, and a valve cap 4.

The valve stem 2 has a cavity 5, which connects to a cavity 6 of the valve body 3 via a first opening at the coaxially arranged neck portion at the first end 7 of the valve body 3. The second opening of the valve body 3 is closed by the valve cap 4.

The valve body 3 is provided, along a longitudinal axis L-L, with a second end having a first outer contact face portion 8. The valve cap 4 is provided with a second outer contact face portion 9, with forms together with the first outer contact face portion 8 a valve head contact face.

Each outer contact face portion 8, 9 is provided with a groove portion, which accommodates a layer of seat facing material at 10, which covers the weld 11 between the valve body 3 and the valve cap 4.

The valve cap 4 is provided with a cylindrical upright wall 12, which mates with a circumferential wall 13 of the cavity 6 and ensures that the valve cap 4 is centered relative to the valve body 3. A tolerance gap 14 is provided between the cylindrical upright wall 12 and the circumferential wall 13.

Figure 2A:
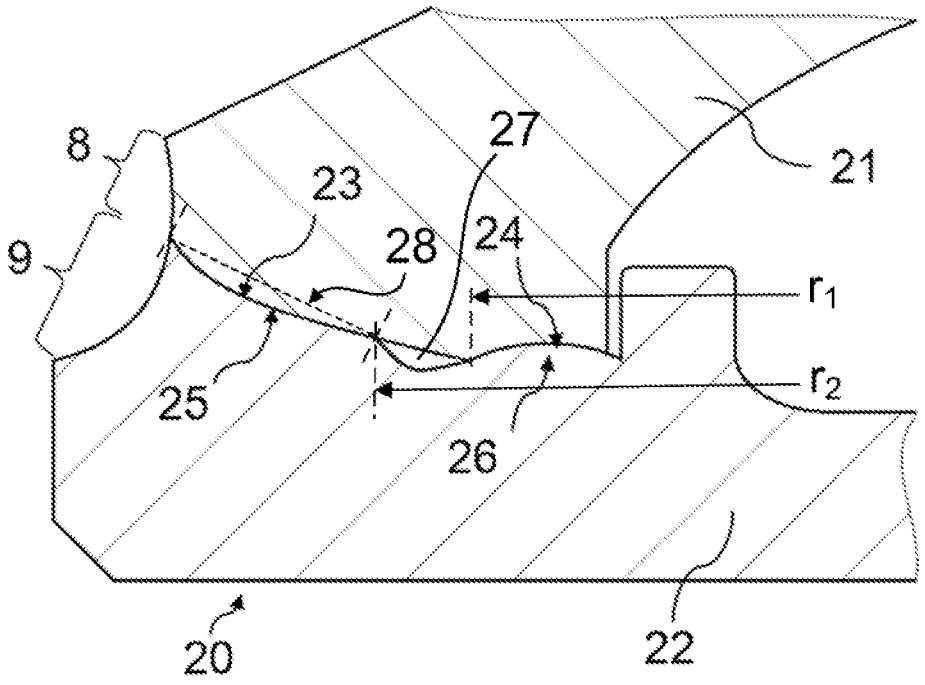
FIGS. 2A and 2B illustrate enlarged longitudinal cross-sectional schematic views of an embodiment of a poppet valve.
Figure 2B:
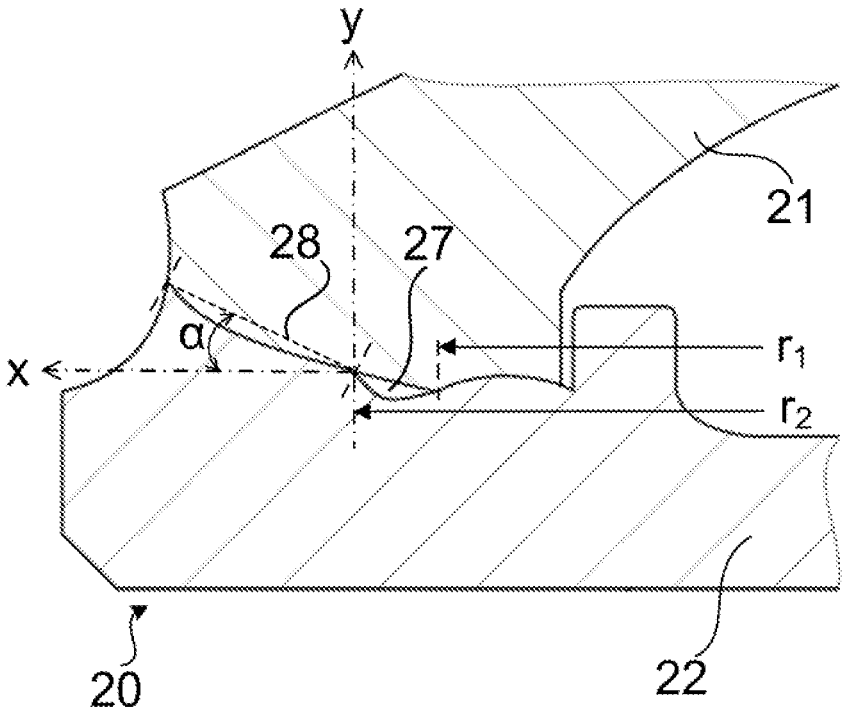

FIGS. 2A and 2B illustrate an enlarged longitudinal cross-sectional schematic views of an embodiment of a poppet valve 20 with a valve body 21 and a valve cap 22. The valve body 21 has a first weld surface 23, which transitions into a first inner contact face portion 24. The valve cap 22 has a second weld surface 25 and a second inner contact face portion 26.

The outer radius $r_1$ of the first inner contact face portion 24 is smaller than the outer radius $r_2$ of the second contact face portion 26, such that a space 27 is provided between the first weld surface 23 and the second inner contact face portion 26. These radii are measured from the the longitudinal axis of the valve body, which should be construed to exist in this figure, and is not explicitly shown due to the magnified scale of enlargement.

The weld to attach the valve body 21 to the valve cap 22 is arranged between the first weld surface 23 and the second weld surface 25. Any residuals of the weld can flow into the space 27, preventing any cracks occurring the in the weld.

A welding line 28 joins the inner edge of the welding interface with the outer edge of the welding interface in this longitudinal cross-section view. The welding line 28 makes a positive angle α with an axis 'x' that is perpendicular to the longitudinal axis of the valve body, with the axis marked 'y' being parallel to the longitudinal axis of the valve body. The longitudinal axis of the valve body should be construed to exist in this figure, and is not explicitly shown due to the magnified scale of enlargement.

The first and second inner contact face portions 24, 26 may furthermore reduce any stresses in the welding area.

Figure 3A:
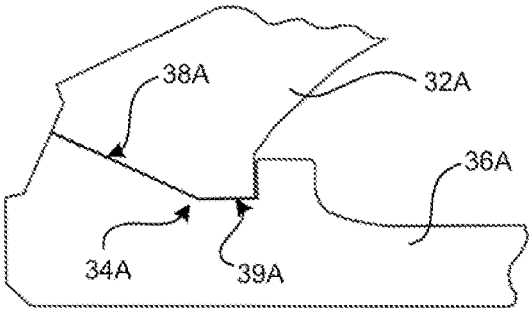
FIGS. 3A, 3B, 3C, 3D, and 3E illustrate enlarged longitudinal cross-sectional schematic views of embodiments of a poppet valve.
Figure 3B:
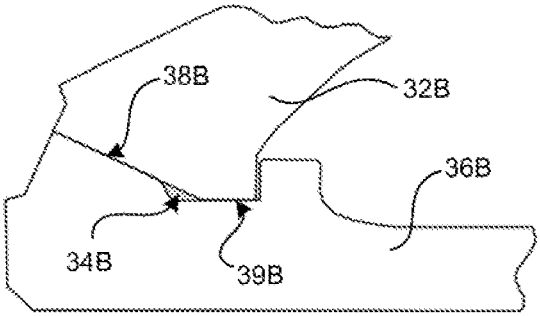
Figure 3C:
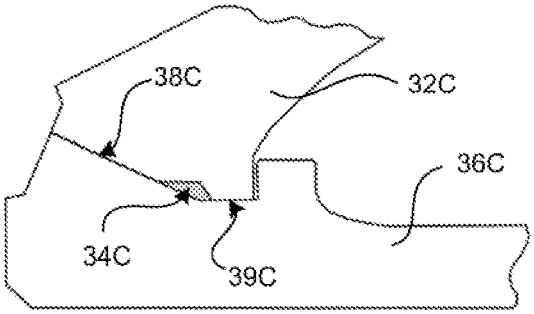
Figure 3D:
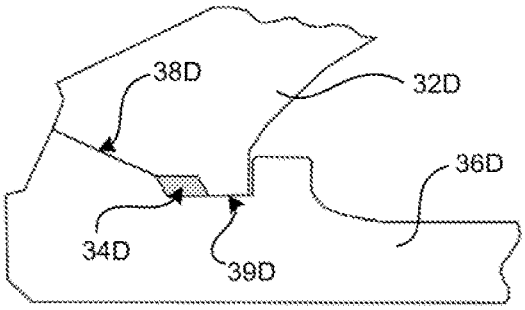
Figure 3E:
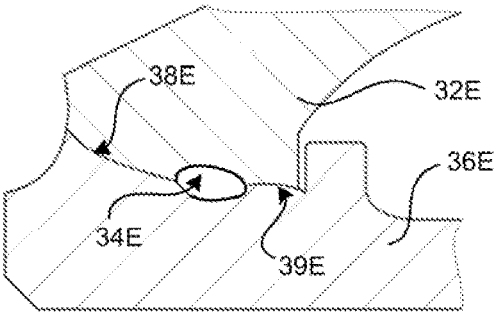

FIGS. 3A-3E illustrate enlarged longitudinal cross-sectional schematic views of a embodiments of a poppet valve. FIG. 3A illustrates a valve body 32A attached to the valve cap 36A, such that no space (indicated as 34A) is provided between the first weld surface 38A and the second inner contact face portion 39A. FIG. 3B illustrates a valve body 32B attached to the valve cap 36B, such that a space 34B is obtained in the valve cap 36B, between the first weld surface 38B and the second inner contact face portion 39B. FIG. 3C illustrates a valve body 32C attached to the valve cap 36C, such that a space 34C is obtained in the valve body 32C, between the first weld surface 38C and the second inner contact face portion 39C. FIG. 3D illustrates a valve body 32D attached to the valve cap 36D, such that a space 34D is obtained in both the valve body 32D and the valve cap 36D, between the first weld surface 38D and the second inner contact face portion 39D. FIG. 3E illustrates a valve body 32E attached to the valve cap 36E, such that a space 34E is obtained in both the valve body 32E and the valve cap 36E, between the first weld surface 38E and the second inner contact face portion 39E. The space 34E is rounded at one or more edges, as seen in the cross-sectional view.

The embodiments illustrated in FIGS. 3A-3E are intended to specifically contrast the specific configurations of obtaining a space between the first weld surface and the second inner contact face portions of particular embodiments of poppet valves. Apart from the configurations of obtaining a space, as described above, the FIGS. 3A-3E illustrate several features that are shown by way of example, and not by way of limitation. By way of example (and not limitation), claimed embodiments may combine configurations of obtaining a space, as described above, with different form(s), shape(s) and/or size(s), of the space itself (also called a vent chamber), as well as of weld surfaces, weld interfaces, outer and/or inner contact faces, groove(s), welding line(s), angle α, and/or other parameters and aspects described herein.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

Numerical ranges recited in this application should be construed to be inclusive of the end points of the stated ranges. The longitudinal axis of the valve body, which may have been omitted in some illustrations for convenience of scale, should be construed to exist in every illustration where it is referred to.

What is claimed is:

1. A poppet valve, comprising:

a valve stem;

a valve body having along a longitudinal axis, a first end and a second end, the first end of the valve body having a coaxially arranged neck portion, the second end of the valve body having a first outer contact face portion;

the valve body further comprising a cavity with a first opening disposed towards the first end and a second opening disposed towards the second end; and a valve cap coaxially arranged on the second end of the valve body, the valve cap configured to close the second opening of the valve body, the valve cap having a second outer contact face portion to form a valve head contact face with the first outer contact face portion; and the first outer contact face portion comprising a first circumferential groove portion forming a curved circumferential face groove with a second circumferential groove portion of the second outer contact face portion, wherein a layer of seat facing material is arranged in the curved circumferential face groove, and wherein the valve cap comprises a cylindrical upright wall, wherein the cylindrical upright wall extends into the second opening of the cavity of the valve body, and wherein the cylindrical upright wall is configured to center the valve cap relative to the valve body.

2. The poppet valve according to claim 1, wherein the valve cap is welded to the valve body, and wherein the weld is arranged between the first and second outer contact face portions.

3. The poppet valve according to claim 1, wherein the valve stem comprises a stem cavity with an opening connected to the first opening of the cavity of the valve body.

4. The poppet valve according to claim 1, wherein the valve body further comprises:

a first inner contact face portion arranged coaxially with the longitudinal axis of the valve body; and a first weld surface extending under the first outer contact face portion, wherein the first inner contact face portion transitions in a radially outward direction into the first weld surface, wherein the valve cap further comprises a second inner contact face portion arranged coaxially with the longitudinal axis of the valve cap, and a second weld surface extending under the second outer contact face portion, and wherein the second inner contact face portion abuts the first inner contact face portion and the first and second weld surfaces contact each other at a welding interface.

5. The poppet valve according to claim 4, wherein a radius of an outer edge of the first inner contact face portion is smaller than a radius of an outer edge of the second inner contact face portion, such that a space is formed between the first weld surface and the second inner contact face portion.

6. The poppet valve according to claim 4, wherein a welding line is defined by joining the inner edge of the welding interface with the outer edge of the welding interface with a line in a longitudinal cross-section of the poppet valve, a length of the welding line being between 0.5 millimeters and 3.5 millimeters.

7. The poppet valve according to claim 6, wherein the welding line makes an angle α between negative 80 degrees and positive 90 degrees with an axis that is perpendicular to the longitudinal axis of the valve body in the longitudinal cross-section, wherein the angle α is positive when the inner edge of the welding interface is longitudinally extended away from valve body toward the valve cap relative to the outer edge of the welding interface, wherein the angle α is negative when the outer edge of the welding interface is longitudinally extended away from valve body toward the valve cap relative to the inner edge of the welding interface, and wherein the angle α is zero when the outer edge of the welding interface and the inner edge of the welding interface lie in an identical plane that is perpendicular to the longitudinal axis of the valve body.

8. The poppet valve according to claim 1, wherein the layer of seat facing material is cobalt based or iron based.

9. A method for manufacturing a poppet valve, the method comprising the steps of:

forming a valve stem;

forming a valve body having, along a longitudinal axis, a first end and a second end;

forming the valve body to comprise a cavity with a first opening disposed towards the first end and a second opening disposed towards the second end;

forming the valve body to comprise a coaxially arranged neck portion at the first end of the valve body;

connecting the valve stem to the neck portion at the first end of the valve body;

forming the valve body to comprise a first outer contact face portion at the second end of the valve body;

forming the valve body such that the first outer contact face portion comprises a circumferential groove portion;

forming a valve cap configured to close the second opening of the valve body, the valve cap comprising a second outer contact face portion;

forming the valve cap such that the second outer contact face portion comprises a groove portion;

forming the valve cap such that the valve cap comprises a cylindrical upright wall, wherein the cylindrical upright wall extends into the second opening of the cavity of the valve body, and wherein the cylindrical upright wall is configured to center the valve cap to the valve body;

arranging the valve cap coaxially with the second end of the valve body such that the first and second outer contact face portions form a valve head contact face and, such that the circumferential groove portions of the first and second outer contact face portions join to form a curved circumferential face groove;

connecting the valve cap to the valve body by arranging a weld between the first and second outer contact face portions; and covering the weld along the curved circumferential face groove with a layer of seat facing material.

10. The method according to claim 9, further comprising affixing the layer of seat facing material using plasma transferred arc welding, laser welding, or projection welding.

11. The method for manufacturing the poppet valve of claim 10, wherein, during the formation of the valve cap, the method further comprises the steps of:

forming the valve cap to comprise a cylindrical upright wall, wherein the cylindrical upright wall is configured to extend into the cavity of the second opening of the valve body, and wherein the cylindrical upright wall is further configured to center the valve cap relative to the valve body.

12. The method for manufacturing the poppet valve of claim 9, wherein, during the formation of the valve stem, the method further comprises the steps of:

forming the valve stem to comprise a valve cavity with an opening; and connecting the opening to the first opening of the cavity of the valve body.

13. The method for manufacturing the poppet valve of claim 9, wherein, during the formation of the valve body and the valve cap, the method further comprises the steps of:

forming the valve body such that it comprises both a first inner contact face portion arranged coaxially with the longitudinal axis of the valve body and a first weld surface which extends under an angle from the first outer contact face portion, wherein the first inner contact face portion transitions in a radially outward direction into the first weld surface;

forming the valve cap such that it comprises both a second inner contact face portion arranged coaxially with the longitudinal axis of the valve cap and a second weld surface which extends under an angle from the second outer contact face portion, and positioning the valve body and valve cap such that the second inner contact face portion abuts the first inner contact face portion and the first and second weld surfaces contact each other when the valve body is connected to the valve cap.

14. The method for manufacturing the poppet valve of claim 13, wherein, during the formation of the valve body and the valve cap, the method further comprises the steps of:

forming the valve body and the valve cap such that a radius of an outer edge of the first inner contact face portion is smaller than a radius of an outer edge of the second inner contact face portion thereby forming a space between the first weld surface and the second inner contact face portion.

15. A hollow poppet valve comprising:

a valve stem;

a valve body comprising a longitudinal axis with a first end and a second end;

the valve body comprising a cavity with a first opening disposed at the first end of the valve body and a second opening disposed at the second end of the valve body;

the first end of the valve body comprising a coaxially arranged neck portion;

the second end of the valve body comprising a first outer contact face portion;

the valve body comprising a first inner contact face portion arranged coaxially on the longitudinal axis of the valve body and comprising a first weld surface extending at an angle from the first outer contact face portion;

wherein the first inner contact face portion transitions in an outward direction into the first weld surface;

a valve cap disposed coaxially on the second end of the valve body, the valve cap configured to seal the second opening of the valve body;

the valve cap comprising a second outer contact face portion;

the first outer contact face portion and the second outer contact face portion are joined to form a curved valve head contact face;

wherein the valve cap comprises a cylindrical upright wall, wherein the cylindrical upright wall extends into the second opening of the cavity of the valve body, and wherein the cylindrical upright wall is configured to center the valve cap to the valve body;

the valve cap further comprises:

a second inner contact face portion arranged coaxially with the longitudinal axis of the valve cap; and a second weld surface extending at an angle from the second outer contact face portion;

wherein the second inner contact face portion abuts the first inner contact face portion, and wherein the first weld surface contacts the second weld surface.

16. The hollow poppet valve of claim 15, wherein an outer edge of the first inner contact face portion has a smaller radius than an outer edge of the second inner contact face portion, such that a space is formed between the first weld surface and the second inner contact face portion.

17. The hollow poppet valve of claim 15, wherein the first outer contact face portion comprises a first circumferential groove portion, wherein the second outer contact face portion comprises a second circumferential groove portion, and wherein the first circumferential groove portion forms a curved circumferential face groove with the second circumferential groove portion.

18. The hollow poppet valve of claim 17, wherein a layer of seat facing material is arranged in the curved circumferential face groove.

19. The hollow poppet valve of claim 15, wherein the valve stem comprises a stem cavity with an opening connected to the first opening of the cavity of the valve body.

20. A poppet valve, comprising:

a valve stem;

a valve body having along a longitudinal axis, a first end and a second end, the first end of the valve body comprising a coaxially arranged neck portion, the second end of the valve body comprising a first outer contact face portion;

the valve body further comprising a cavity with a first opening disposed towards the first end and a second opening disposed towards the second end; and a valve cap coaxially arranged on the second end of the valve body, the valve cap configured to close the second opening of the valve body;

wherein the valve cap comprises a cylindrical upright wall, wherein the cylindrical upright wall extends into the second opening of the cavity of the valve body, and wherein the cylindrical upright wall is configured to center the valve cap to the valve body;

the valve cap comprising a second outer contact face portion forming a valve head contact face with the first outer contact face portion;

the first outer contact face portion comprising a first circumferential groove portion and the second outer contact face portion comprising a second circumferential groove portion, the first circumferential groove portion and the second circumferential groove portion forming a curved circumferential face groove in the poppet valve.

* * * * *